US009240193B2

(12) United States Patent
James

(10) Patent No.: US 9,240,193 B2
(45) Date of Patent: Jan. 19, 2016

(54) MODULATION OF SPEECH SIGNALS

(71) Applicant: Cochlear Limited, Macquarie University (AU)

(72) Inventor: Christopher James, Toulouse (FR)

(73) Assignee: Cochlear Limited, Macquarie University, NSW (AU)

( * ) Notice: Subject to any disclaimer, the term of this patent is extended or adjusted under 35 U.S.C. 154(b) by 291 days.

(21) Appl. No.: 13/746,305

(22) Filed: Jan. 21, 2013

(65) Prior Publication Data

US 2014/0205119 A1 Jul. 24, 2014

(51) Int. Cl.

| | |
|---|---|
| ***G10L 25/90*** | (2013.01) |
| ***G10L 21/00*** | (2013.01) |
| ***H04R 25/00*** | (2006.01) |
| ***G10L 21/013*** | (2013.01) |

(52) U.S. Cl.

CPC ..... *G10L 21/00* (2013.01); *G10L 21/013* (2013.01); *H04R 25/353* (2013.01); *G10L 25/90* (2013.01); *H04R 25/554* (2013.01); *H04R 25/70* (2013.01); *H04R 2225/31* (2013.01); *H04R 2225/43* (2013.01)

(58) Field of Classification Search

USPC ..... 704/205–208; 381/320

See application file for complete search history.

(56) References Cited

U.S. PATENT DOCUMENTS

| | | | | |
|---|---|---|---|---|
| 6,885,986 | B1 * | 4/2005 | Gigi | 704/207 |
| 2005/0107843 | A1 * | 5/2005 | McDermott et al. | 607/57 |
| 2005/0197832 | A1 * | 9/2005 | Vandali et al. | 704/206 |
| 2006/0052841 | A1 * | 3/2006 | Daly et al. | 607/57 |
| 2012/0004705 | A1 * | 1/2012 | James | 607/57 |

* cited by examiner

*Primary Examiner* — Abul Azad

(57) ABSTRACT

Methods, systems, and devices for processing an audio signal are provided. An example method includes mapping a fundamental frequency of an audio signal to a modulation frequency. An output of the mapping is less than the fundamental frequency when the fundamental frequency is greater than an intersection frequency. The intersection frequency is a frequency at which the output of the mapping is the fundamental frequency.

33 Claims, 11 Drawing Sheets

MODULATION OF SPEECH SIGNALS

BACKGROUND

Individuals who suffer from certain types of hearing loss may benefit from the use of a hearing prosthesis. Depending on the type and the severity of the hearing loss, an individual can employ a hearing prosthesis to assist a recipient in perceiving at least a portion of a sound. A partially implantable hearing prosthesis typically includes an external component that performs at least some processing functions and an implanted component that at least delivers a stimulus to a body part in an auditory pathway, such as a cochlea, an auditory nerve, a brain, or any other body part that contributes to the perception of sound. In the case of a totally implantable hearing prosthesis, the entire device is implanted in the body of the recipient.

SUMMARY

A first sound processor is also provided. The first sound processor comprises a module that is configured to compress a modulation frequency such that the modulation frequency is within a range of pitch frequencies a recipient is capable of perceiving.

A first method for processing an audio signal is provided. The first method includes mapping a fundamental frequency of the audio signal to a modulation frequency. An output of the mapping is less than the fundamental frequency when the fundamental frequency is greater than an intersection frequency. The intersection frequency is a frequency at which the output of the mapping is the fundamental frequency.

A second method for processing an audio signal is also provided. The second method includes detecting a plurality of amplitude peaks of M spectral components of an audio signal. Each spectral component corresponds to one of M frequencies, and M is an integer greater than one. The second method also includes, for each of M spectral components, determining whether N amplitude peaks have been detected. N is an integer greater than one. The second method further includes beginning a gate-on period upon determining that N amplitude peaks of the spectral component have been detected. The second method also includes including the spectral component in a first spectral signal and a second spectral signal. The first spectral signal is generated before the second spectral signal.

A non-transitory computer-readable memory having stored thereon instructions executable by a computing device to perform functions for processing an audio signal is provided. The functions include modulating one or more spectral signals that include one or more spectral components of the audio signal at a modulation rate. The modulation rate depends on a range of pitch frequencies a recipient can perceive.

Additionally, a second sound processor is provided. The second sound processor includes a module configurable to modulate at least one spectral signal at an effective modulation frequency. A ratio of the effective modulation frequency to a fundamental frequency voiced speech is less than one over a range of frequencies. The at least one spectral signal includes information indicative of one or more spectral components of an audio signal that includes voiced speech.

These as well as other aspects and advantages will become apparent to those of ordinary skill in the art by reading the following detailed description, with reference where appropriate to the accompanying drawings. Further, it is understood that this summary is merely an example and is not intended to limit the scope of the invention as claimed.

BRIEF DESCRIPTION OF THE FIGURES

Presently preferred embodiments are described below in conjunction with the appended drawing figures, wherein like reference numerals refer to like elements in the various figures, and wherein.

DETAILED DESCRIPTION

The following detailed description describes various features, functions, and attributes of the disclosed systems, methods, and devices with reference to the accompanying figures. In the figures, similar symbols typically identify similar components, unless context dictates otherwise. The illustrative embodiments described herein are not meant to be limiting. It will be readily understood that the aspects of the present disclosure, as generally described herein, and illustrated in the figures, can be arranged, substituted, combined, separated, and designed in a wide variety of different configurations, all of which are contemplated herein.

Figure 1:
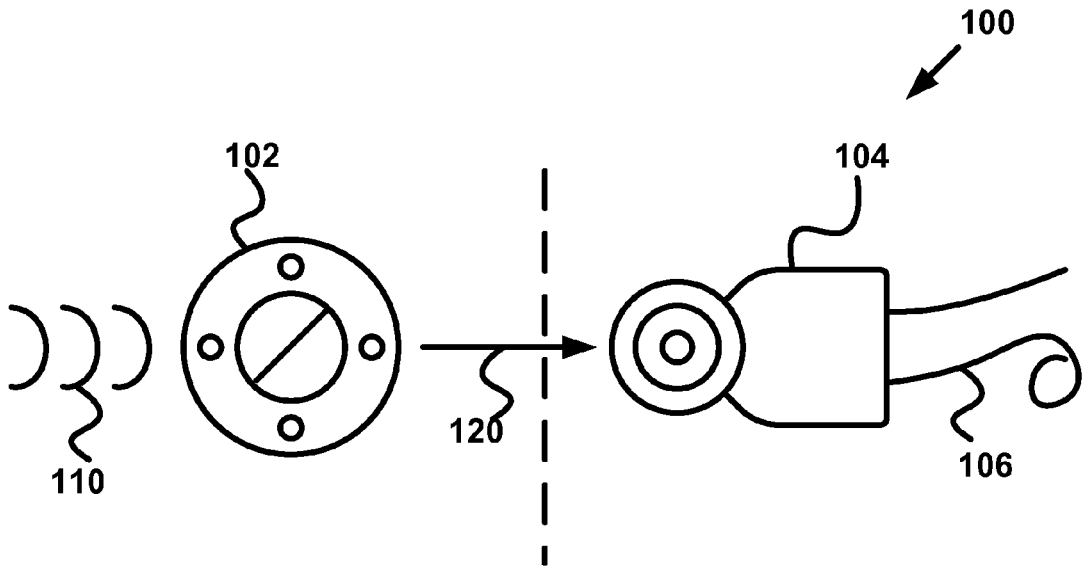
FIG. 1 illustrates components of a hearing prosthesis, according to an example.

FIG. 1 illustrates a hearing prosthesis 100. The hearing prosthesis 100 includes a processing unit 102 and an implanted unit 104. A recipient utilizes the hearing prosthesis 100 to assist the recipient in perceiving a sound. In FIG. 1, the hearing prosthesis 100 is a partially implantable cochlear implant. The processing unit 102 is external to the recipient's body, and the implanted unit 104 is implanted in the recipient's body. In another example, the hearing prosthesis 100 is a totally implantable hearing prosthesis, in which case the processing unit 102 and the implanted unit 104 are implanted in the recipient's body. Additionally, a single enclosure may contain the components of the processing unit 102 and the implanted unit 104. In yet another example, the hearing prosthesis 100 is an auditory brain stem implant or any other hearing prosthesis or combination of hearing prostheses now known (e.g., a hearing prosthesis system combining electrical and mechanical stimulation) or later developed. In still other examples, components of processing unit 102 are distributed among one or more other enclosures, some or all of which might be external to and remote from the recipient.

The processing unit 102 receives a sound 110. In one example, the sound 110 originates from a source in an environment. In another example, the sound 110 originates from an external device configured to send the sound signal to the processing unit 102, such as an audio streaming device. The processing unit 102 processes the sound 110 and generates a stimulation signal based on the sound 110.

In processing the sound 110, the processing unit 102 determines whether the sound 110 includes voiced speech. In response to determining that the sound 110 does not include voiced speech, the processing unit 102 operates in a first operating mode. In response to determining that the sound 110 includes voiced speech, the processing unit 102 operates in a second operating mode. When operating in the second operating mode, the processing unit 102 modulates one or more spectral components of the stimulation signal and/or one or more spectral components of a plurality of additional stimulation signals.

In one example, the processing unit 102 modulates the stimulation signal by modulating one or more spectral components of the audio signal at a modulation frequency. In another example, the processing unit 102 modulates a rate at which stimulation signals are generated by generating stimulation signals during gate-on periods. The length of a gate-on period compared to the time between gate-on periods may effectively modulate a plurality of the stimulation signals over a period of time. In both examples, the effective modulation frequency is based on a range of pitch frequencies a recipient of the stimulus or stimuli can perceive. The preceding two examples are discussed in more detail with respect to FIGS. 4A-4C.

The processing unit 102 also provides a power signal to the implanted unit 104. The processing unit 102 modulates the power signal based on the stimulation signal such that a modulated power signal 120 contains both the power signal and the stimulation signal. In one example, the processing unit 102 inductively transfers the modulated power signal 120 to the implanted unit 104. In another example, the processing unit 102 transmits the modulated power signal 120 to the implanted unit 104 using a different transmission technique.

The implanted unit 104 receives the modulated power signal 120 and separates the modulated power signal 120 into the stimulation signal and the power signal. The implanted unit 104 generates a stimulus based on the stimulation signal and delivers the stimulus to a body part in an auditory pathway of the recipient. In the example of FIG. 1, in which the hearing prosthesis 100 is a partially implantable cochlear implant, the implanted unit 104 includes an electrode array 106 that is implanted in one of the recipient's cochleae. Upon receiving the stimulation signal, the implanted unit 104 generates an electrical signal based on the stimulation signal. The implanted unit 104 sends the electrical signal to the electrode array 106, which causes one or more electrodes included on the electrode array 106 to deliver one or more electrical stimuli to the recipient's cochlea. Stimulating the recipient's cochlea causes the recipient to perceive at least a portion of the sound 110.

In an example in which the hearing prosthesis 100 is not a cochlear implant, the implanted unit 104 includes a component that is implanted (or otherwise placed) in one of the recipient's auditory nerves, the recipient's brain, or any other body part capable of being stimulated to assist the recipient in perceiving at least a portion of a sound. Delivering a stimulus to the body part stimulates the body part, allowing the recipient to perceive at least a portion of the sound 110.

Figure 2:
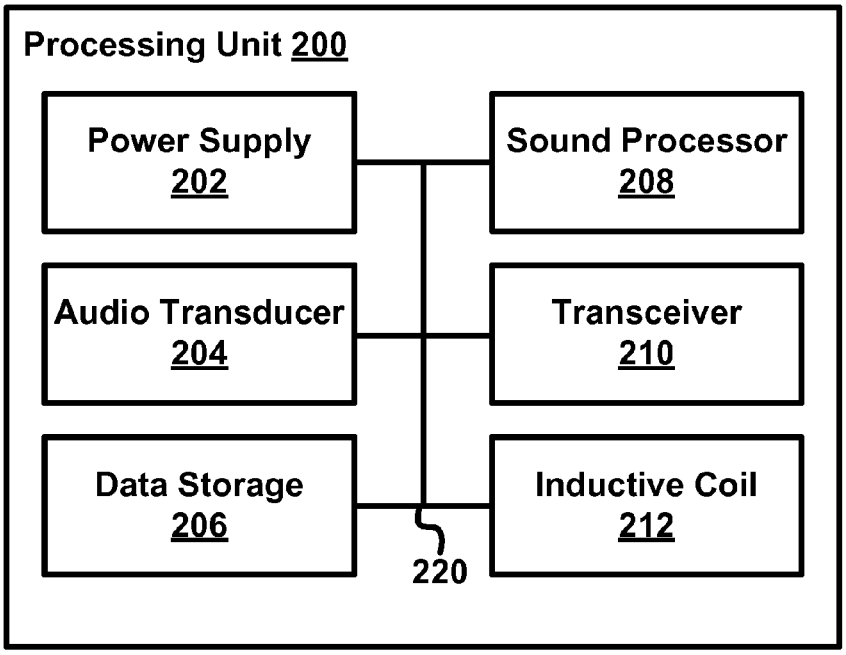
FIG. 2 is a block diagram of components of a processing unit depicted in FIG. 1, according to an example.

FIG. 2 is a block diagram of a processing unit 200. The processing unit 200 is one example of the processing unit 102 depicted in FIG. 1. The processing unit 200 includes a power supply 202, an audio transducer 204, a data storage 206, a sound processor 208, a transceiver 210, and an inductive coil 212, all of which may be connected directly or indirectly via circuitry 220.

The power supply 202 supplies power to various components of the processing unit 200 and can be any suitable power supply, such as a rechargeable or a non-rechargeable battery. The power supply 202 also provides power to the implanted unit 104 via the inductive coil 212. In one example, the power supply 202 is a battery that can be charged wirelessly, such as through inductive charging. In another example, the power supply 202 is not a replaceable or rechargeable battery and is configured to provide power to the components of the processing unit 200 for the operational lifespan of the processing unit 200 and the implanted unit 104.

The audio transducer 204 receives the sound 110 from a source in an environment and sends a sound signal to the sound processor 208 that includes information indicative of the sound 110. In one example, the processing unit 200 is a cochlear implant. In another example, the processing unit 200 is an auditory brain stem implant or any other hearing prosthesis or combination of hearing prostheses now known (e.g., a hearing prosthesis system combining electrical and mechanical stimulation) or later developed that is suitable for assisting a recipient of the hearing prosthesis 100 in the perceiving sound 110. In this example, the audio transducer 204 is an omnidirectional microphone, a directional microphone, an electro-mechanical transducer, or any other audio transducer now known or later developed suitable for use in the type of hearing prosthesis employed. Furthermore, in other examples the audio transducer 204 includes one or more additional audio transducers.

The data storage 206 includes any type of non-transitory, tangible, computer-readable media now known or later developed configurable to store program code for execution by a component of the processing unit 200 and/or other data associated with the processing unit 200. The data storage 206 stores information used by the sound processor 208 to process the sound signal. The data storage 206 may also store one or more computer programs executable by the sound processor 208.

The sound processor 208 is configured to determine a stimulation signal suitable for causing the implanted unit 104 to deliver a stimulus to a body part in one of the recipient's auditory pathways. In one example, the sound processor 208 includes one or more digital signal processors. In another example, the sound processor 208 is any processor or combination of processors now known or later developed suitable for use in a hearing prosthesis. Additionally, the sound processor 208 may include additional hardware for processing the sound signal, such as an analog-to-digital converter and/or one or more filters.

The sound processor 208 determines the stimulation signal by processing the sound signal received from the audio transducer 204. The stimulation signal includes information indicative of a stimulus current for one or more of the electrodes included on the electrode array 106. The sound processor 208 determines one or more spectral components of a sample of the audio signal and modulates the one or more spectral components at an effective modulation frequency. As used herein, the term "effective modulation frequency" refers to a modulation frequency that is achieved by either estimating a fundamental frequency of voiced speech in the sound signal or a varying a rate at which stimulations signals are generated. A ratio of the effective modulation frequency to the fundamental frequency is less than one over a range of frequencies. Using the effective modulation frequency to modulate the one or more spectral components may improve the recipient's ability to perceive speech included in the sound signal. In one example, the sound processor 208 processes the sound signal by implementing the system described herein with respect to FIG. 4A. Additionally, the sound processor 208 accesses the data storage 206 to retrieve one or more computer programs that cause the sound processor 208 to execute at least a portion of the methods described herein with respect to FIGS. 7-9.

The transceiver 210 receives the stimulation signal from the sound processor 208 and modulates the stimulation signal with the power signal to form the modulated power signal 120. In one example, the transceiver 210 modulates the stimulation signal with the power signal using a time-division multiple-access modulation scheme. In another example, the transceiver 210 uses any modulation scheme now known or later developed suitable for inductively transmitting the stimulation signal and the power signal to the implanted unit 104.

The transceiver 210 sends the modulated power signal to the inductive coil 212, which inductively transmits the modulated power signal 120 to the implanted unit 104. The inductive coil 212 is constructed of any material or combination of materials suitable for inductively transferring the modulated power signal 120 to the implanted unit 104.

Figure 3A:
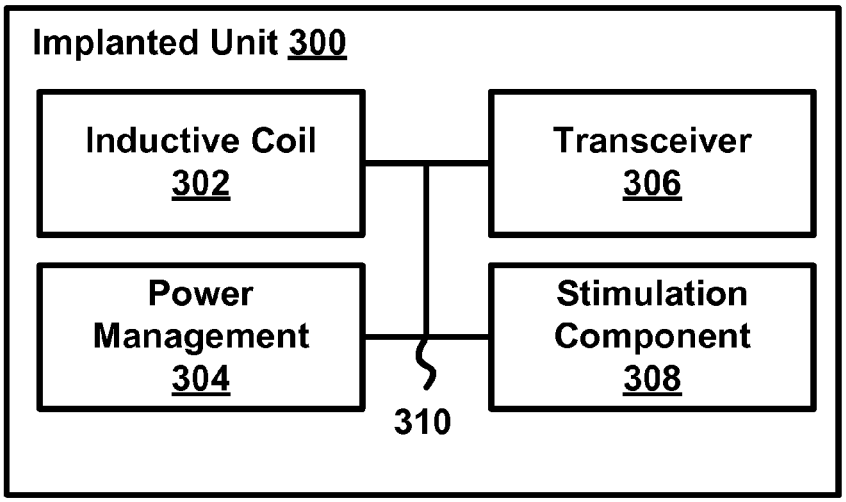
FIG. 3A is a block diagram of components of an implanted unit depicted in FIG. 1, according to an example.

FIG. 3A is a block diagram of an implanted unit 300 of a hearing prosthesis. The implanted unit 300 is one example of the implanted unit 104 depicted in FIG. 1. The implanted unit 300 includes an inductive coil 302, power management 304, a transceiver 306, and a stimulation component 308, all of which are connected directly or indirectly via circuitry 310. For illustrative purposes, the implanted unit 300 is the implanted unit 104 depicted in FIG. 1.

The inductive coil 302 inductively receives the modulated power signal 120 from the processing unit 102. The inductive coil 302 is constructed of any biocompatible material or combination of materials suitable for inductively receiving power from the processing unit 102. The inductive coil 302 transfers the power signal to the power management 304. The power management 304 distributes power to the components of the implanted unit 300. The power management 304 includes a component suitable for separating the modulated power signal 120 into the stimulation signal and the power signal, such as the component described with respect to FIG. 3B.

Figure 3B:
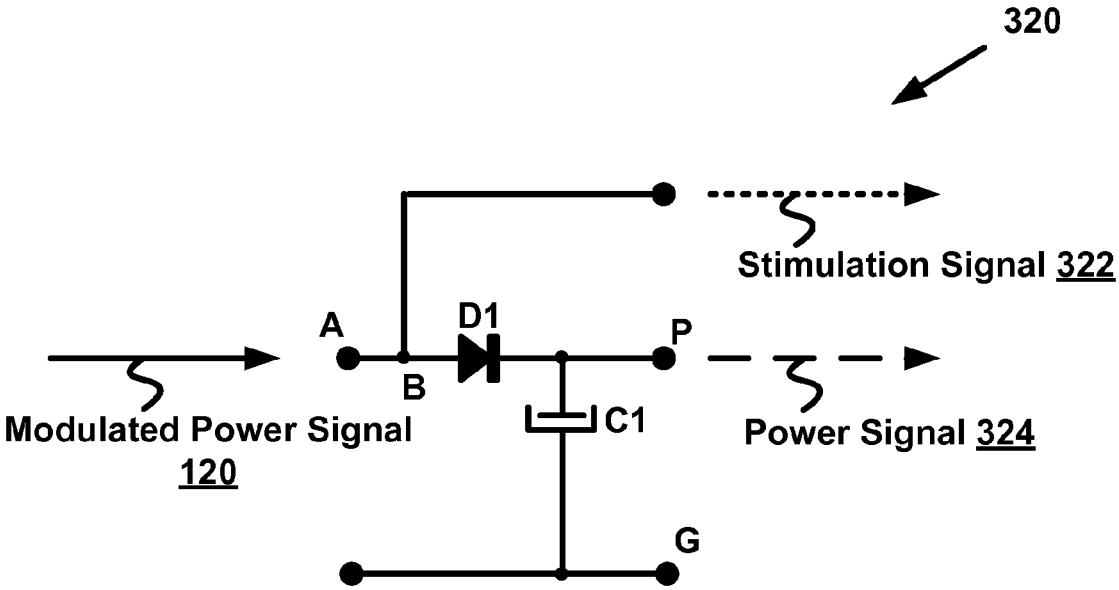
FIG. 3B is an electrical diagram of a component configured to separate a power signal and a data signal, according to an example.

FIG. 3B is an electrical diagram of a component 320 configured to separate the modulated power signal 120 into the stimulation signal and the power signal. The component 320 includes a rectifier formed by a diode D1 and a capacitor C1. Characteristics of the diode D1 and the capacitor C1 depend on the modulation frequency of the modulated power signal 120. The stimulation signal 322 is extracted from the modulated power signal 120 at a point B upstream of the diode D1. The rectifier removes the stimulation signal 322 from the modulated power signal 120, allowing the power signal 324 to be extracted at terminal P with respect to the reference ground G.

Returning to FIG. 3A, the power management 304 sends the stimulation signal to the transceiver 306, which transfers the stimulation signal to the stimulation component 308. The stimulation component 308 generates a stimulus based on the stimulation signal. In one example, the stimulation component 308 includes a first subcomponent configured to generate the stimulus and a second subcomponent configured to deliver the stimulus to a body part in an auditory pathway, such as a cochlea, an auditory nerve, a brain, and any other organ or body part capable of assisting a recipient in perceiving at least a portion of the sound 110. The first subcomponent generates the stimulus and sends the stimulus to the second component. The second subcomponent delivers the stimulus to the body part of the recipient.

For instance, since implanted unit 300 is the implanted unit 104, the stimulation component 308 includes a signal generator and the electrode array 106. The signal generator generates an electrical signal based on the stimulation signal and sends the electrical signal to the electrode array 106. The electrical signal causes one or more of the electrodes included on the electrode array 106 to deliver one or more electrical stimuli to a portion of the recipient's cochlea. The one or more electrical stimuli cause the cochlea to stimulate an auditory nerve, thereby allowing the recipient to perceive at least a portion of the sound 110.

Figure 4A:
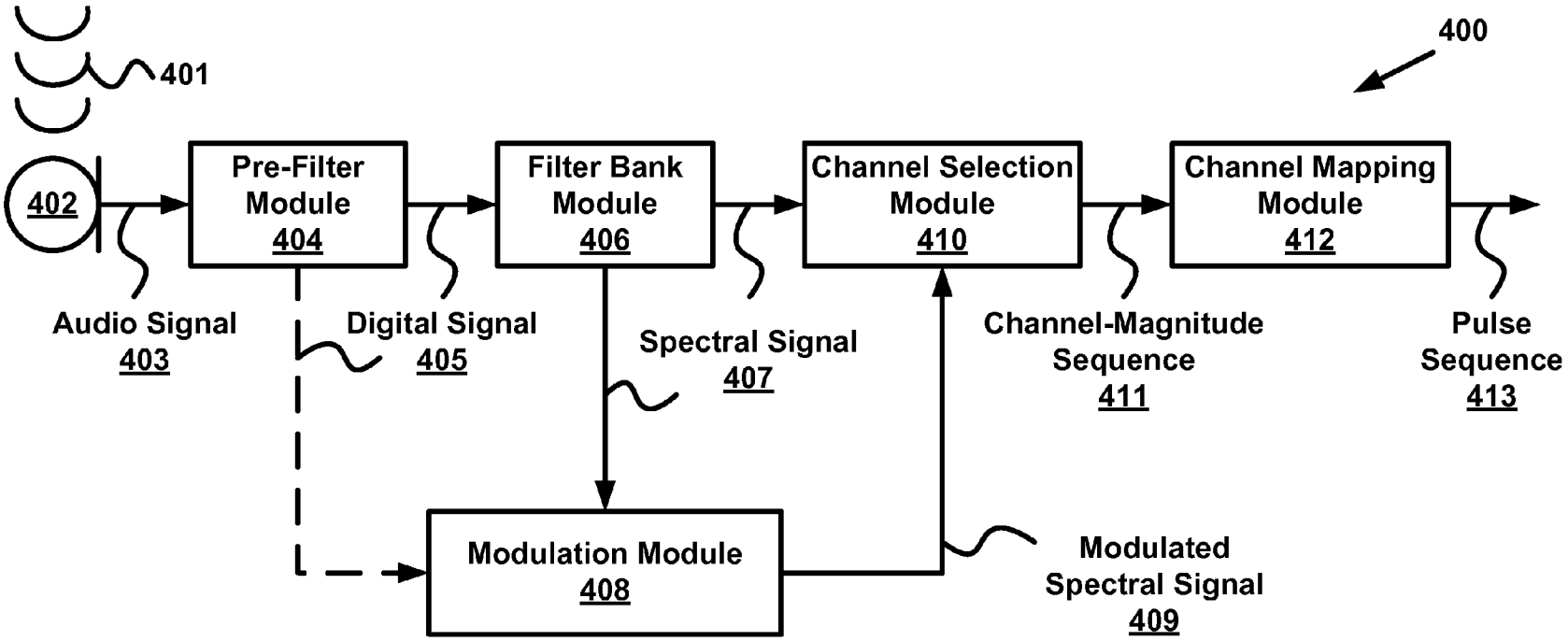
FIG. 4A is a block diagram of a system for processing an audio signal, according to an example.

FIG. 4A is a block diagram of a system 400 for processing an audio signal. The system 400 includes an audio transducer 402, a pre-filter module 404, a filter bank module 406, a modulation module 408, a channel selection module 410, and a channel mapping module 412. For illustrative purposes, the system 400 is described with reference to the processing unit 200.

The audio transducer 402 is the same as or is substantially similar to the audio transducer 204. In one example, the sound processor 208 includes hardware and/or software configurable to perform the operations described with respect to the modules 404-412. In another example, the processing unit 200 includes one or more additional components configured to assist the sound processor 208 in performing the operations described with respect to the module 404-412. For instance, if the sound processor 208 performs the operations described with respect to modules 406-412, the processing unit 200 includes an additional component configured to perform the operations described with respect to the pre-filter module 404.

The audio transducer 402 receives a sound 401 from the environment. The audio transducer 402 sends an audio signal 403 that includes information indicative of the sound 401 to the pre-filter module 404. The pre-filter module 404 includes an amplifier configured to amplify high frequency components of the audio signal 403. The pre-filter module 404 is also configured to employ an adaptive gain control. The adaptive gain control accounts for variations in an amplitude of the audio signal 403. The pre-filter module 404 further includes an analog-to-digital converter suitable for digitizing the audio signal 403. In one example, the analog-to-digital converter uses a sampling rate of 16 KHz to generate a 16-bit digital signal. In another example, a different sampling rate and/or bit representation is used when digitizing the audio signal 403.

The output of the pre-filter module 404 is a digital signal 405. The filter bank module 406 receives the digital signal 405 and generates a spectral signal 407 that includes one or more spectral components of the digital signal 405. A spectral component of the digital signal 405 is an amplitude of the digital signal at a corresponding frequency or over a range of frequencies. In one example, the amplitude is a sound pressure level (SPL) of the digital audio signal 405.

The filter bank module 406 determines M spectral components corresponding to M frequency channels, where M is an integer greater than one. In one example, frequency channels are linearly spaced below 1 KHz and logarithmically spaced above 1 KHz. In another example, the frequency channels are spaced according to any scheme suitable for processing the digital signal 405.

For a cochlear implant, M may be equal to a number of electrodes included on an electrode array. That is, each of the M electrodes corresponds to a frequency channel. In one example, M is twenty-two. In another example, M is greater than or less than twenty-two, and may depend on a number of surviving neurons in the recipient's cochlea. For another type of hearing prosthesis, the value of M is any integer suitable for generating a stimulation signal.

The filter bank module 406 contains M band-pass filters and M envelope detectors, with each band-pass filter paired to an envelope detector. Each pair of band-pass filters and envelope detectors corresponds to a frequency channel. A portion (e.g., a sample) of the digital signal 405 passes through each band-pass filter, and an associated envelope detector determines an envelope of the portion of the digital signal 405 for one of the M frequency channels. In one example, each band-pass filter is implemented using a Fast Fourier Transform, and the output of each envelope detector is based on a portion of the digital signal 405 that passes through an associated band-pass filter. In another example, the output of each envelope detector may be a maximum amplitude or an average amplitude of the envelope. The filter bank module 406 generates the spectral signal 407 based on the outputs of the M envelope detectors.

The modulation module 408 receives the spectral signal 407 and generates a modulated spectral signal 409. In some situations, the recipient of a hearing prosthesis may have reduced speech prosody perception due to having a limited range of frequencies in which the recipient can perceive pitch. A pitch of a human voice may vary from about 100 Hz to about 500 Hz. A typical recipient of a hearing prosthesis, such as a cochlear implant, may only be able to accurately perceive speech prosody at frequencies from about 100 Hz to about 185 Hz. Thus, the recipient may have difficulty perceiving speech from speakers whose voices have pitches that are outside of the pitch perception range, such as women and children. Additionally, some recipients who speak tonal languages, such as Mandarin Chinese, may have difficulty distinguishing phonetically similar words which differ only in tonal pitch.

One way of improving speech prosody perception of recipients of hearing prostheses is to modulate the spectral components included in a stimulation signal. The modulation module 408 is configured to modulate the M spectral components of the spectral signal 407. In one example, the modulation module 408 modulates the M spectral components included in the spectral signal 407. In this example, the modulation module 408 estimates the fundamental frequency of voiced speech included in each sample of the spectral signal 407. This example is discussed in further detail with respect to FIG. 4B. In another example, the modulation module 408 generates the modulated spectral signal 409 during a gate-on period. The timing and length of each gate-on period may depend on the timing of peaks in the amplitude of the spectral component corresponding to one of the M frequency channels. In this manner, the modulation module 408 sends pulses of the spectral signal 407 during gate-on periods, which effectively modulates the spectral signal 407 to generate the modulated spectral signal 409. This example is described further with respect to FIG. 4C.

Figure 4B:
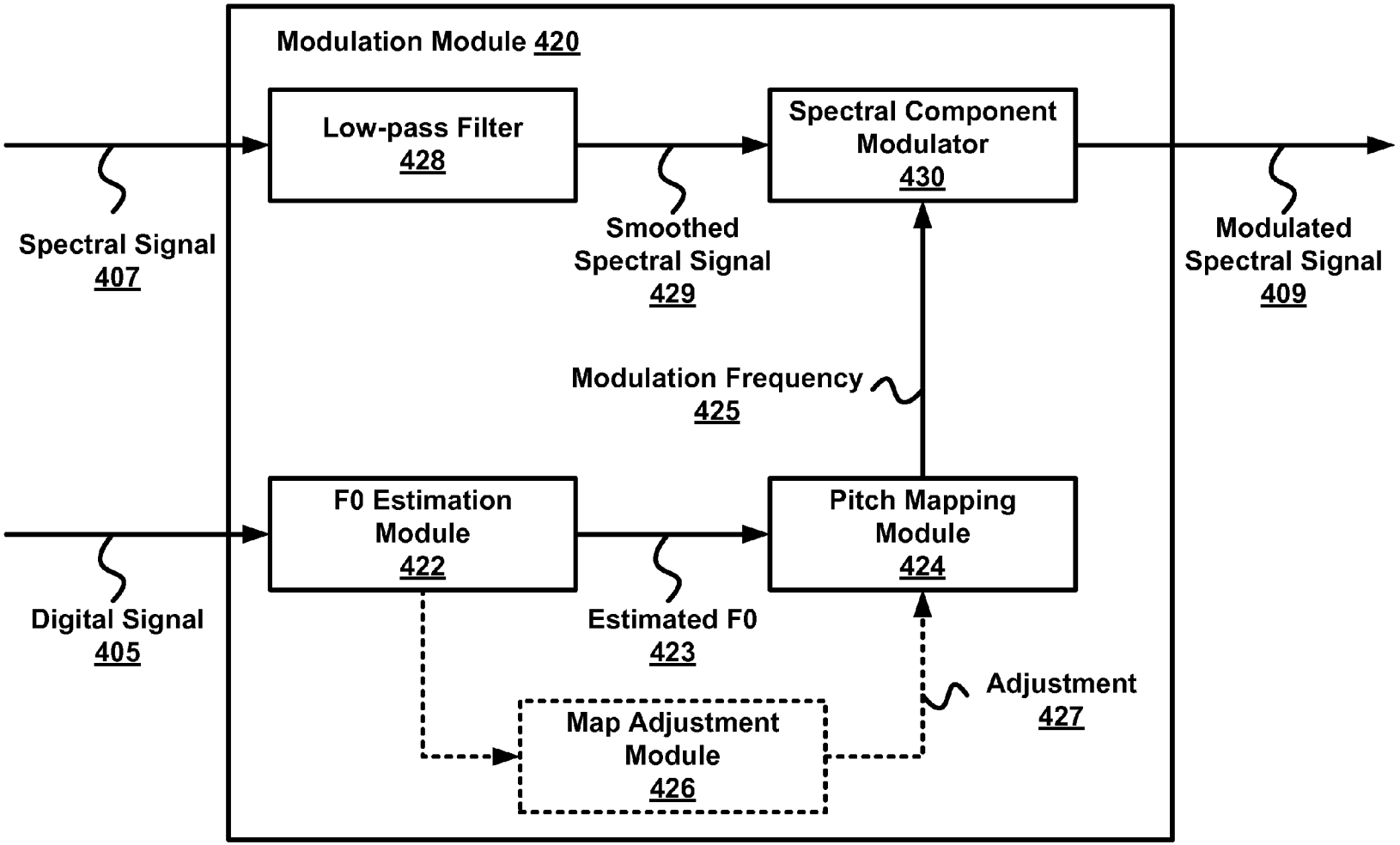
FIG. 4B is a block diagram of a modulation module depicted in FIG. 4A, according to a first example.

In more detail now, FIG. 4B is a block diagram of a modulation module 420. The modulation module 420 is a first example of the modulation module 408 depicted in FIG. 4A. The modulation module 420 includes a fundamental frequency (F0) estimation module 422, a pitch mapping module 424, a map adjustment module 426, a low-pass filter 428, and a spectral component modulator 430. The map adjustment module 426 is optional, as indicated by dashed lines.

The fundamental frequency estimation module 422 is configured to estimate the pitch of voiced speech included in the sound 401 by estimating the fundamental frequency of the digital signal 405. The fundamental frequency estimation module 422 estimates the fundamental frequency using any algorithm, method, and/or process now known or later developed that is suitable for estimating the fundamental frequency of a signal. The fundamental frequency estimation module 422 sends an estimated fundamental frequency 423 to the pitch mapping module 424. The pitch mapping module 424 determines a modulation frequency 425 based on the estimated fundamental frequency 423.

As previously described, modulating the M spectral components at a modulation frequency within a range of frequencies the recipient can perceive may, in some cases, improve the recipient's perception of speech. More specifically, modulating the M spectral components may cause a resulting stimulus to allow the recipient to more clearly perceive tonality and prosody, and may assist the recipient in gender identification. Additionally, modulating each of the M channels—a subset of which are included in a stimulation signal—may assist some recipients in more accurately identifying a voice from a variety of sounds and/or sound sources in an environment.

Figure 5:
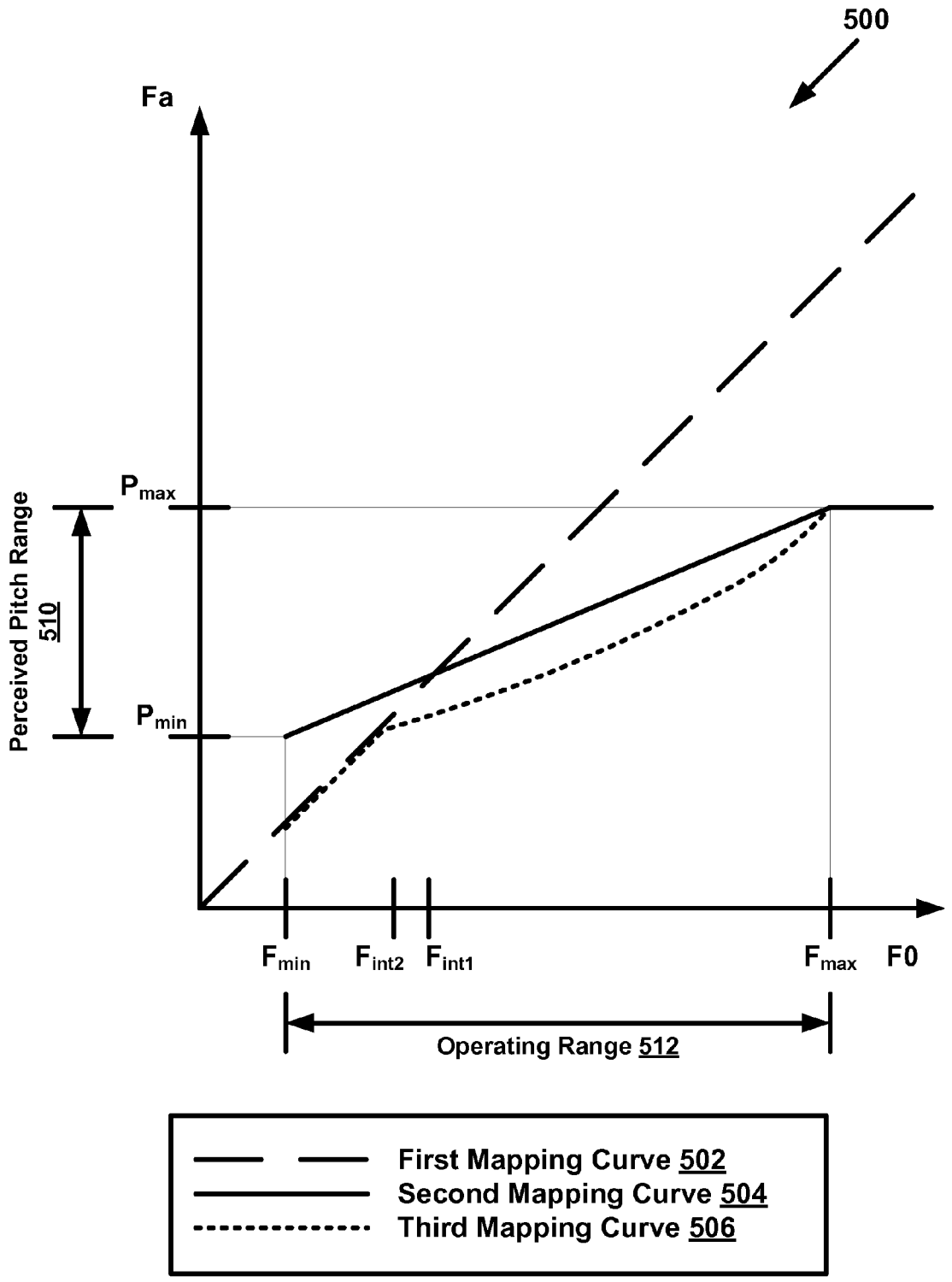
FIG. 5 is a graph of example mapping functions that may be used to map a fundamental frequency to a modulation frequency.

The pitch mapping module 424 uses a mapping function to determine the modulation frequency 425 as a function of the estimated fundamental frequency 423. FIG. 5 is a graph 500 of example curves of mapping functions the pitch mapping module 420 may employ to determine the modulation frequency 425. On the graph 500, "Fa" is the modulation frequency, and "F0" is the estimated fundamental frequency. The graph 500 illustrates three curves: a first mapping curve 502, a second mapping curve 504, and a third mapping curve 506. The first mapping curve 502 corresponds to a first mapping function in which the modulation frequency equals the estimated fundamental frequency. The first mapping function may provide some recipients with improved recognition of prosodic content within a range of frequency pitches the recipient is capable of perceiving. On the graph 500, a perceived pitch range 510 of the recipient is indicated by a maximum pitch frequency $P_{max}$ and minimum pitch frequency $P_{min}$. However, if the fundamental frequency is above $P_{max}$, modulating the spectral signal at the modulation frequency may result in minimal, if any, improvement in the speech prosody perceived by the recipient.

One way to improve speech prosody perceived by the recipient is to compress the modulation frequency such that the modulation frequency is within the perceived pitch range 510 (e.g., between $P_{max}$ and $P_{min}$). The second mapping curve 504 corresponds to a second mapping function that is a linear function of the estimated fundamental frequency. In one example, the second mapping function is given by the following equation:

$$Fa(F0) = P_{max} + \frac{(F0 - F_{max})(P_{max} - P_{min})}{F_{max} - F_{min}}$$

where $F_{max}$ and $F_{min}$ are a maximum fundamental frequency and minimum fundamental frequency, respectively, of an operating range 512 of fundamental frequencies. In one example, the operating range 512 is standardized for multiple sound processors and/or processing units of hearing prostheses implementing the system 400. For instance, in order to determine a modulation frequency for a typical range of pitches, $F_{min}$ is about 80 Hz and $F_{max}$ is about 350 Hz. In another example, values of $F_{min}$ and $F_{max}$ are tailored to recipients in a specific geographic area. In yet another example, values of $F_{min}$ and $F_{max}$ depend on an amount and severity of hearing loss of an individual recipient. In this example, an audiologist or other specialist may determine $F_{max}$ and $F_{min}$ when calibrating, or fitting, the hearing prosthesis to the recipient.

The third mapping curve 506 corresponds to a third mapping function that is a non-linear function of the estimated fundamental frequency. As illustrated by the third mapping curve 506, the third mapping function may accentuate a difference between modulation frequencies at higher estimated fundamental frequencies. This increases the difference between the modulation frequency and the estimated fundamental frequency, thereby improving speech prosody perception at higher estimated fundamental frequencies. In another example, the third mapping function is adjusted to accentuate a different range of modulation frequencies. In yet another example, the third mapping function is any type of non-linear function suitable for determining the modulation frequency as a function the estimated fundamental frequency.

For the second and third mapping functions, the modulation frequency equals the estimated fundamental frequency at an intersection frequency. That is, the intersection frequency is a frequency at which one of the second mapping curve 506 and/or the third mapping curve 508. In the graph 500, a first intersection frequency $F_{int1}$ corresponds to the second mapping curve 504, and a second intersection frequency $F_{int2}$ corresponds to the third mapping curve 506. In one example, the modulation frequency is less than the estimated fundamental frequency when the estimated fundamental frequency is greater than the intersection frequency. When the estimated fundamental frequency is less than the intersection frequency, the modulation frequency is greater than the estimated fundamental frequency. For example, consider the second mapping function. As illustrated by the second mapping curve 504, the modulation frequency determined by the second mapping function is greater than the estimated fundamental frequency when the estimated fundamental frequency is less than the first intersection frequency $F_{int1}$. When the estimated fundamental frequency is greater than first intersection frequency $F_{int1}$, the modulation frequency determined by the second mapping function is less than the estimated fundamental frequency.

In another example the modulation frequency is approximately equal to the estimated fundamental frequency when the estimated fundamental frequency is less than the intersection frequency. For example, consider the third mapping function. As illustrated by the third mapping curve 506, the modulation frequency determined by the third mapping function is less than the estimated fundamental frequency when the estimated fundamental frequency is greater than the second intersection frequency $F_{int2}$. When the estimated fundamental frequency is less than second intersection frequency $F_{int2}$, the modulation frequency determined by the third mapping function is approximately equal to the estimated fundamental frequency. FIG. 5 illustrates this example, as the third mapping curve 506 approximately overlaps the first mapping curve 502 when the estimated fundamental frequency is less than or equal to the second intersection frequency $F_{int2}$. In yet another example, the modulation frequency is less than the fundamental frequency in the operating range 512.

Returning to FIG. 4B, the pitch mapping module 424 determines the modulation frequency 425 using the second mapping function or the third mapping function when the estimated fundamental frequency 423 is within the operating range 512. In one example, the modulation frequency 425 is $P_{max}$ if the estimated fundamental frequency 423 is greater than $F_{max}$, and is $P_{min}$ if the estimated fundamental frequency 423 is less than $P_{min}$. In another example, the pitch mapping module 424 does not determine the modulation frequency 425 if the estimated fundamental frequency 423 is outside of the operating range 512.

The modulation module 420 may include the optional map adjustment module 426. The map adjustment module 426 receives the estimated fundamental frequency 423 from the fundamental frequency estimation module 422. The map adjustment module 426 then determines an adjustment 427 to the mapping function based on one or more statistics of estimated fundamental frequencies. Applying the adjustment 427 to the mapping function shifts the operating range 512, and thus the mapping curves 504, 506, right or left on the x-axis of the graph 500. This allows the modulation module 420 to adapt the mapping function to the range of pitches most frequently encountered by the recipient while using the hearing prosthesis. The one or more statistics include an average estimated fundamental frequency, a median estimated fundamental frequency, a maximum estimated fundamental frequency, a minimum estimated fundamental frequency, and/or any other statistic of two or more estimated fundamental frequencies suitable for use by the map adjustment module 426 to determine the adjustment 427 to the mapping curve.

To maintain the proper relationship between the modulation frequency 425 and the estimated frequency 423, one or more relationships between $F_{max}$ and $F_{min}$ is approximately constant. For instance, a difference between $F_{max}$ and $F_{min}$ is approximately constant. Alternatively, a ratio of $F_{max}$ to $F_{min}$ is approximately constant.

The low-pass filter 428 receives and filters each of the M spectral components of the spectral signal 407. The output of the low-pass filter 428 is a smoothed spectral signal 429 that includes M smoothed spectral components. A cut-off frequency of the low-pass filter 428 is generally less than $P_{min}$, such as at about 60 Hz. The smoothed spectral signal 429 retains spectral information included in the spectral signal 407 that is useful in discriminating changes in voiced speech between two samples of the spectral signal 407, such as a syllabic rate and/or a phonemic rate.

The spectral component modulator 430 modulates the smoothed spectral signal 429 at the modulation frequency 425 to generate the modulated spectral signal 409. In one example, the spectral component modulator 430 amplitude-modulates the M smoothed spectral components of the smoothed spectral signal 429, perhaps by using raised cosine amplitude modulation. In another example, the spectral component modulator 430 uses any suitable form of modulation now known or later developed that is suitable for modulating the M spectral components to generate the modulated spectral signal 409.

Figure 4C:
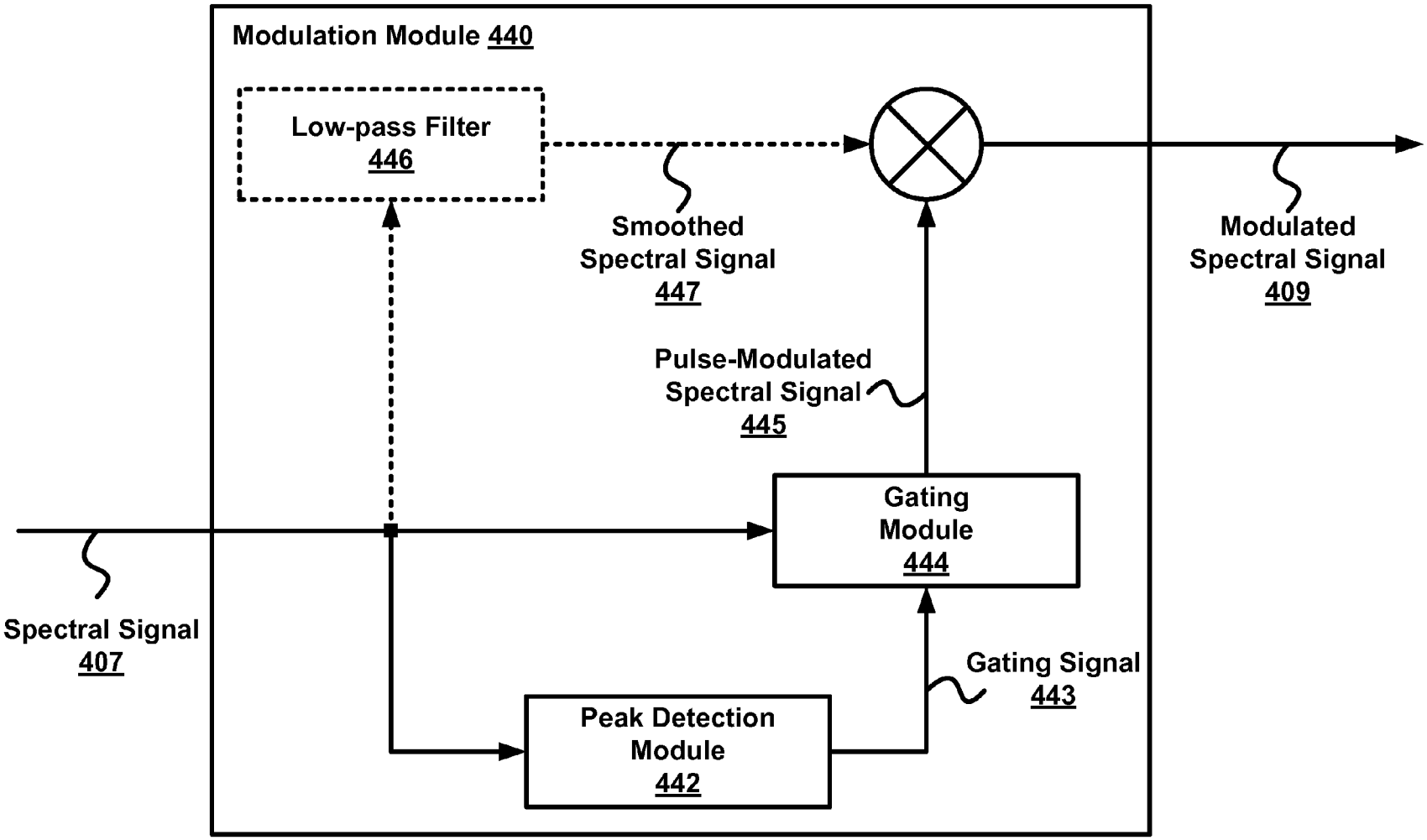
FIG. 4C is a block diagram of a modulation module depicted in FIG. 4A, according to a second example.

In more detail now, FIG. 4C is a block diagram of a modulation module 440. The modulation module 440 is a second example of the modulation module 408 depicted in FIG. 4A. The modulation module 440 includes a peak detector 442, a gating module 444, and an optional low-pass filter 446. Unlike the modulation module 420 described with respect to FIG. 4B, the modulation module 440 does not modulate each spectral component of the spectral signal 407. Instead, for each spectral component of the spectral signal 407, the modulation module 440 determines gate-on periods in which a given spectral component of the spectral signal 407 is included in the modulated spectral signal 409. Each gate-on period is followed by a gate-off period during which the given spectral component is not included in the modulated spectral signal 409. The output stimuli dependent on the modulated spectral signal 409 are timed such that bursts of the modulated spectral signal 409 correspond to similarly timed pulses of the stimulation signals transmitted from the processing unit 200 to an implanted unit, such as the implanted unit 104 depicted in FIG. 1. Sending the bursts during gate-on periods and not during gate-off periods may effectively modulate the spectral signal 407. For some recipients, sending stimuli in bursts may result in stimuli that improve speech prosody perception. Furthermore, the resulting burst stimuli may also cause the user to perceive more natural-sounding speech.

The timing and lengths of a gate-on period and a gate-off period are determined by detecting amplitude peaks of the spectral signal 407 at the M frequency channels. The peak detection module 442 receives the spectral signal 407 and detects the amplitude peaks of each spectral component. In the example illustrated in FIG. 4C, the peak detector 442 receives the spectral signal 407 from the filter bank 406.

The peak detection module 442 tracks the number of amplitude peaks of each spectral component using a counter. The peak detection module 442 increases the value of the counter by one upon detecting an amplitude peak of the gating spectral component. When a value of the counter equals N, indicating that the peak detector detected the $N^{th}$ the amplitude peak, the peak detection module 442 zeros the counter.

The peak detection module 442 compares the counter to zero in order to determine whether to include a first indication or a second indication in a gating signal 442. If the counter equals zero, the peak detection modules 442 includes the first indication in the gating signal 443; otherwise, the peak detection module 442 includes the second indication in the gating signal 443. The first indication causes the gating module 444 to output at least one sample of the spectral signal 407 as the pulse-modulated spectral signal 445, and the second indication causes the gating module 444 to stop outputting samples of the spectral signal 407. Thus, the first indication indicates the beginning of a gate-on period, and the second indication indicates the end of the gate-on period.

In one example, the peak detector 442 determines a difference between two successive peaks and compares the peaks to a threshold difference. If the difference is greater than the threshold difference, which may occur at the onset of voiced speech included in the sound 401, the peak detector 442 zeros the counter. This has the effect of increasing a frequency of gate-on periods during signal outsets, thereby reducing the effect of noise on peak detection and retaining energy included in the signal onset. When the difference is less than the threshold difference, the peak detector 442 increases the counter by one, thus beginning (or continuing) a gate-off period until the $N^{th}$ peak is detected.

In one example, a value of N depends on a range of pitch frequencies the recipient can perceive. With reference to FIG. 5, N may depend on a ratio of $F_{max}$ to $P_{max}$, a ratio of the operating range 512 to the perceived pitch range 510, a ratio between a maximum expected pitch and $P_{max}$, and/or any other factor or ratio suitable for determining a modulation rate of the unvoiced spectral signal 407. Since the ratio between a given frequency in the perceived pitch range and the operating range is between two and three, N is typically either two or three. However, N may be greater than three in some examples.

The gating module 444 receives the spectral signal 407 and the gating signal 443. The peak detection module 442 sends the gating signal 443 to the gating module 444 for each of the M spectral components. The gating signal 443 includes an indication of whether to pass a sample of an associated spectral component of the spectral signal 407. The gating module 444 includes all passed spectral components in a pulse-modulated spectral signal 445. In one example, the pulse-modulated spectral signal 445 is a continuous signal. That is, the gating module 444 may output a portion of each sample of the spectral signal 407. In another example, the gating module 444 sends the pulse-modulated spectral signal 445 at specific time intervals.

In one example, the timing of each pulse-modulated spectral signal 445 is synchronized to the detection of a peak. In this example, a difference in time between two pulse-modulated spectral signals 445 is approximately constant, regardless of the length of each gate-on period. The gating module 444 outputs a pulse-modulated spectral signal 445 upon detecting the peak and at fixed time interval(s) after detecting the peak. Alternatively, the difference in time between two pulse-modulated spectral signals 445 may depend on an average length of a gate-on period. For instance, if the gating module 444 is configured to output three pulses during each gate-on period, the time interval between any two pulse-modulated spectral signals 445 depends on the average of length of a gate-on period. In this example, the peak detection module 442 and/or the gating module 444 is configured to determine the average length of a gate-on period based on the lengths of at least two previous gate-on periods. The gating module 444 adjusts the time interval between pulses of the pulse-modulated spectral signal 445 based on the average length.

In another example, the timing of each pulse-modulated spectral signal 445 is synchronized to coincide to a pulse of a stimulus delivered to the recipient. In this example, a difference in time between two stimulus pulses is approximately constant. Alternatively, the difference in time between two stimulus pulses may depend on the average time of a gate-on period, as previously described with respect to the time interval between two pulse-modulated spectral signals 445. Additionally, the gating module 444 may include components for delaying one or more gate-on periods such that the gate-on period is substantially centered over amplitude peaks.

In yet another example, the gating module 444 includes components for duplicating one or more spectral signals 407 included in the pulse-modulated spectral signal 445. For example, the gating module 444 outputs a first sample of the pulse-modulated spectral signal 445 at the beginning of a gate-on period, which coincides with detecting the $N^{th}$ amplitude peak of a spectral component. The gating module 444 outputs a second sample of the pulse-modulated spectral signal 445 after a time interval. The amplitudes of the M spectral components of the first sample and the second sample of the pulse-modulated spectral signal 445 are approximately the same. Maintaining the amplitudes of the M spectral components during the gate-on period may alleviate variations in a perceived loudness of the voiced speech by the recipient.

The gating module 444 may vary a rate and/or a number of pulse-modulated spectral signals 445 for a gate-on period. The peak detector 442 determines an average time between detections of the amplitude peaks of the gating spectral component. In one example, the gating module 444 varies the interval between pulses of the pulse-modulated spectral signal 445 directly with a change in the average time between peak detections. In another example, the gating module 444 varies a number of pulse-modulated spectral signals 445 generated directly with the change in the average time between peak detections.

Figure 6A:
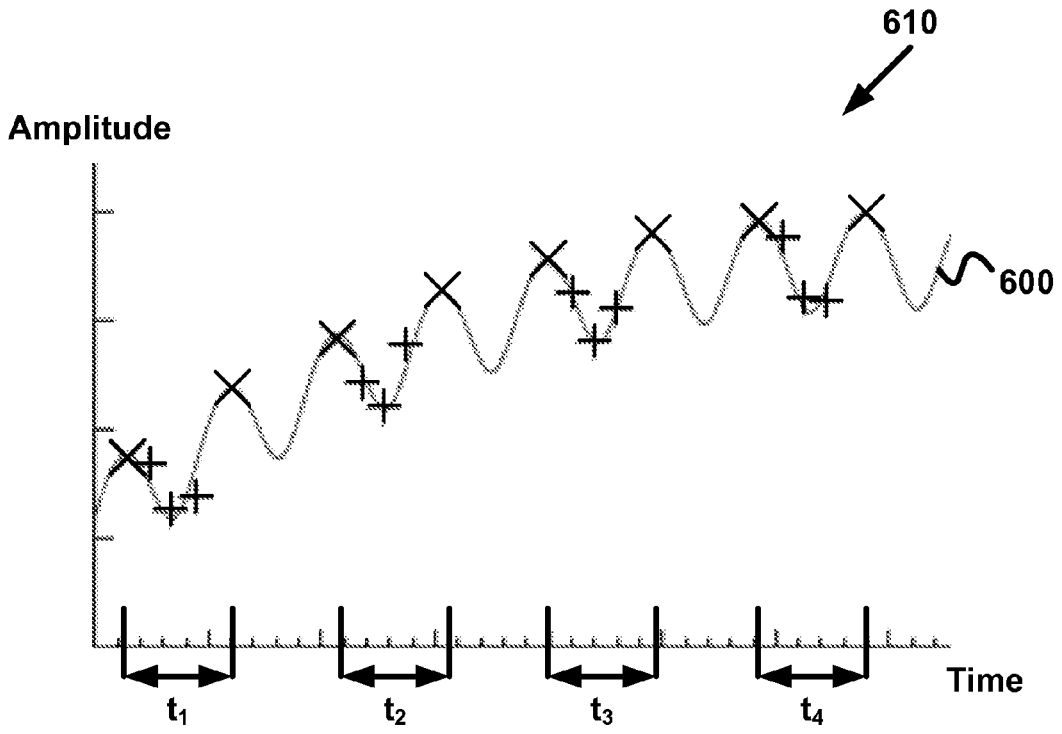
FIGS. 6A-6C are example graphs of envelopes of a spectral component of an audio signal with respect to time.
Figure 6B:
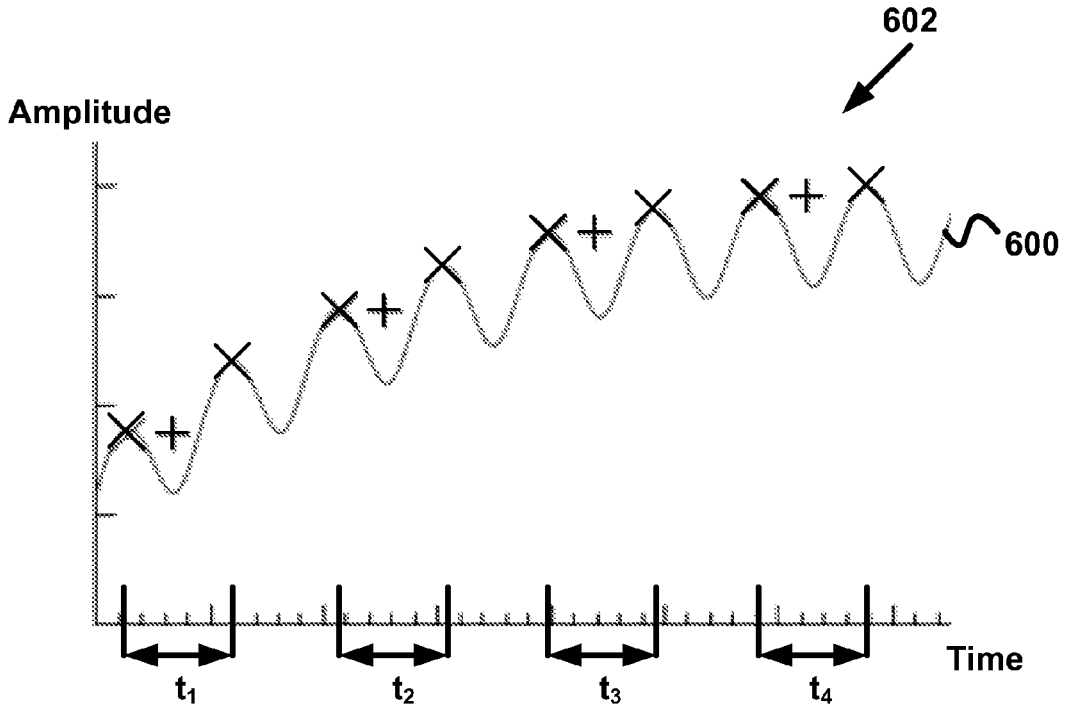
Figure 6C:
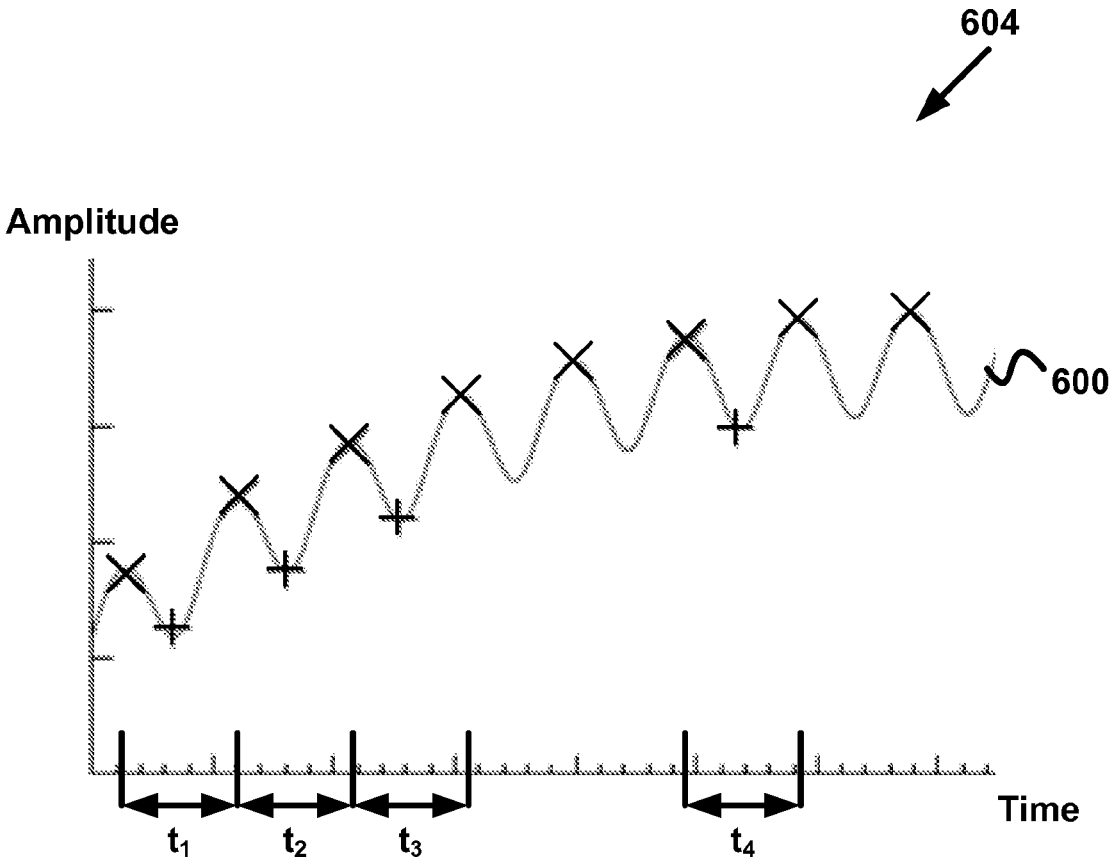

FIGS. 6A-6C are graphs of envelopes of a spectral component 600 with respect to time. In each of FIGS. 6A-6C, detected peaks by the peak detector 442 are indicated by an "X". The gating module 444 outputs a first sample of the pulse-modulated spectral signal 445 upon detecting the $N^{th}$ amplitude peak, which begins a gate-on period, and subsequent outputs of samples of the pulse-modulated spectral signal 445 are indicated by a "+". The gating spectral component 600 is one of the M spectral components included in the spectral signal 407.

FIG. 6A is a first graph 610 of the gating spectral component 610 in which N is two. The graph 610 includes four gate-on periods $t_1$-$t_4$. During each of the gate-on periods $t_1$-$t_4$, the gating module 444 passes four samples of the spectral signal 407. In this example, the gating module 444 synchronizes the time at which a sample is passed to the detection of the peak. Thus, for each of the gate-on periods $t_1$-$t_4$, a first sample is passed after a first time interval, a second sample is passed after a second time interval, and a third sample is passed after a third time interval.

FIG. 6B is a second graph 620 of the gating spectral component 600. In this example, N is also two, and the graph 620 includes four gate-on periods $t_1$-$t_4$. The gating module 444 outputs two samples of the spectral signal 407 during each of the gate-on periods $t_1$-$t_4$. For each of the gate-on periods $t_1$-$t_4$, the gating module 444 outputs the first sample of the pulse-modulated spectral signal 445 at the peak that begins each gate-on period. The gating module 444 outputs the second sample of the pulse-modulated spectral signal 445 after a first time interval during each of the gate-on periods $t_1$-$t_4$. The second sample is a duplicate of the first sample; that is, each of the M spectral components in the second sample has the same amplitude as the first sample.

FIG. 6C is a third graph 630 of the gating spectral component 630. In this example, N is three. As in the second graph 620, the gating module 444 outputs two samples of the pulse-modulated spectral signal 445 during each of the gate-on periods $t_1$-$t_4$. The gate module 444 outputs the first sample at the beginning of the gate-on period, and outputs the second sample after a certain time interval after outputting the first sample.

In this example, the peak detector 442 determines a difference between successive peaks prior to zeroing the counter. For instance, a first difference between a second detected peak and a first detected peak is greater than a threshold difference. Thus, the gate-on periods $t_1$-$t_3$ are successive with no intervening gate-off periods. The peak detector 442 determines that a third difference between a fourth detected peak and the third detected peak is less than the threshold difference. Upon determining that the third difference is less than the threshold difference, the peak detector 442 increments the counter, ending the third gate-on period $t_3$ and beginning a gate-off period. After detecting the third peak during the gate-off period, the peak detector 442 zeros the counter, beginning the fourth gate-on period $t_4$.

Returning to FIG. 4C, the pulse-modulated spectral signal 445 is sent to the channel selection module 410 as the modulated spectral signal 409. In another example, the modulation module 440 includes an optional low-pass filter 446. The low-pass filter 446 is the same as or is substantially similar to the low-pass filter 428 described with respect to FIG. 4B. The low-pass filter 446 outputs a smoothed spectral signal 447, which is the same as or is substantially similar to the smoothed low-pass signal 429 described with respect to FIG. 4B. In this example, the modulation module 440 is configured to mix the smoothed spectral signal 447 with the pulse-modulated spectral signal 445. In another example, the modulation module 440 is configured to alternate samples of the smoothed spectral signal 447 with the spectral signal 407 during gate-on periods. In yet another example, the modulation module 440 is configured to output the pulse-modulated spectral signal 445 as the modulated spectral signal 409 during gate-on periods, and to output the smoothed spectral signal 447 as the modulated spectral signal 409 during gate-off periods.

Returning to FIG. 4A, the channel selection module 410 determines an operating mode and a sequence of one or more spectral components to include in the channel magnitude sequence 411. In one example, the channel selection module 410 determines an operating mode of the sound processor 208 prior to determining channel-magnitude sequence 411. In this example, the operating mode is either a first operating mode, such as an "unvoiced" operating mode, or a second operating mode such, such as a "voiced" operating mode. The channel selection module 410 determines the operating mode by determining whether the spectral signal 407 includes information indicative of voiced speech. If the spectral signal 407 does not include voiced speech, the channel selection module 410 determines that the operating mode is the unvoiced operating mode. In contrast, the channel selection module 410 determines that the operating mode is the voiced operating mode upon determining that the spectral signal 407 includes voiced speech. Alternatively, the channel selection module 410 may process a different signal, such as the digital signal 405, to determine the operating mode. The channel selection module employs one or more methods, algorithms, and/or processes now known or later discovered that are suitable for determining whether the spectral signal 407 (or other sample of the audio signal 403) includes voiced speech.

In the voiced mode, the channel section module 410 selects P spectral components to include in the channel-mapping sequence 411 from the M spectral components included in the modulated spectral signal 409, where P is an integer between one and M. In the unvoiced mode, the channel selection module 410 selects the P spectral components to include in the channel mapping sequence 411 from the M spectral components included in the spectral signal 407. For both of the voiced mode and the unvoiced mode, the channel selection module 410 uses any algorithm, method, and/or process now known or later discovered that is suitable for selecting the P spectral components to include in the channel mapping sequence 411.

In another example, such as an example in which the modulation module 408 is the modulation module 440 described with respect to FIG. 4C, the channel selection module 410 does not determine the operating mode of the sound processor 208. In this example, the channel selection module 410 determines the channel-magnitude sequence 411 based on the one or more spectral components included in the modulated spectral signal 409. Additionally, the channel selection module 410 may not receive the spectral signal 407 from the filter bank module 406 in this example.

The channel mapping module 412 receives the channel-magnitude sequence 411 from the channel selection module 410 and generates a pulse sequence 413. For each of the P selected spectral components, the channel mapping module 412 determines a pulse set ($f_n$, $I_n$), where $I_n$, is a current for an electrode corresponding to the frequency channel $f_n$. Each electrode included on the electrode array 106 has a mapping curve that indicates a stimulus current for the electrode as a function of SPL. Fitting the hearing prosthesis 100 to the recipient typically involves determining a threshold current (T-Level) and a maximum comfort level (C-Level) for each electrode. The T-Level is a stimulus current below which the recipient is unable to perceive a tone at a given frequency corresponding to the electrode. The C-Level is a stimulus current above which the recipient perceives the tone as being too loud. In one example, the current is zero if the SPL is less than a threshold level ($SPL_T$), the current varies approximately logarithmically between the T-Level and the C-Level if the SPL is between $SPL_T$ and a maximum level ($SPL_C$), and the current is the C-Level if the SPL is greater than an $SPL_C$. For each electrode, the channel mapping module 412 identifies the current corresponding to the SPL on the electrode's mapping curve.

In one example, the channel-mapping module 412 may arrange one or more pulse sets from high frequency to low frequency if N is greater than one. For example, if N is three, the pulse sequence 422 includes three pulse sets: ($f_1$, $I_1$), ($f_2$, $I_2$), and ($f_3$, $I_3$). If $f_3$ is greater than $f_2$ and $f_2$ is greater than $f_1$, the channel mapping module 410 arranges the pulse sets in the pulse sequence 422 in the following order: ($f_3$, $I_3$), ($f_2$, $I_2$), ($f_1$, $I_1$). The sound processor 208 then uses the pulse sequence 422 to generate the stimulation signal that is sent to the implanted unit 104.

Figure 7:
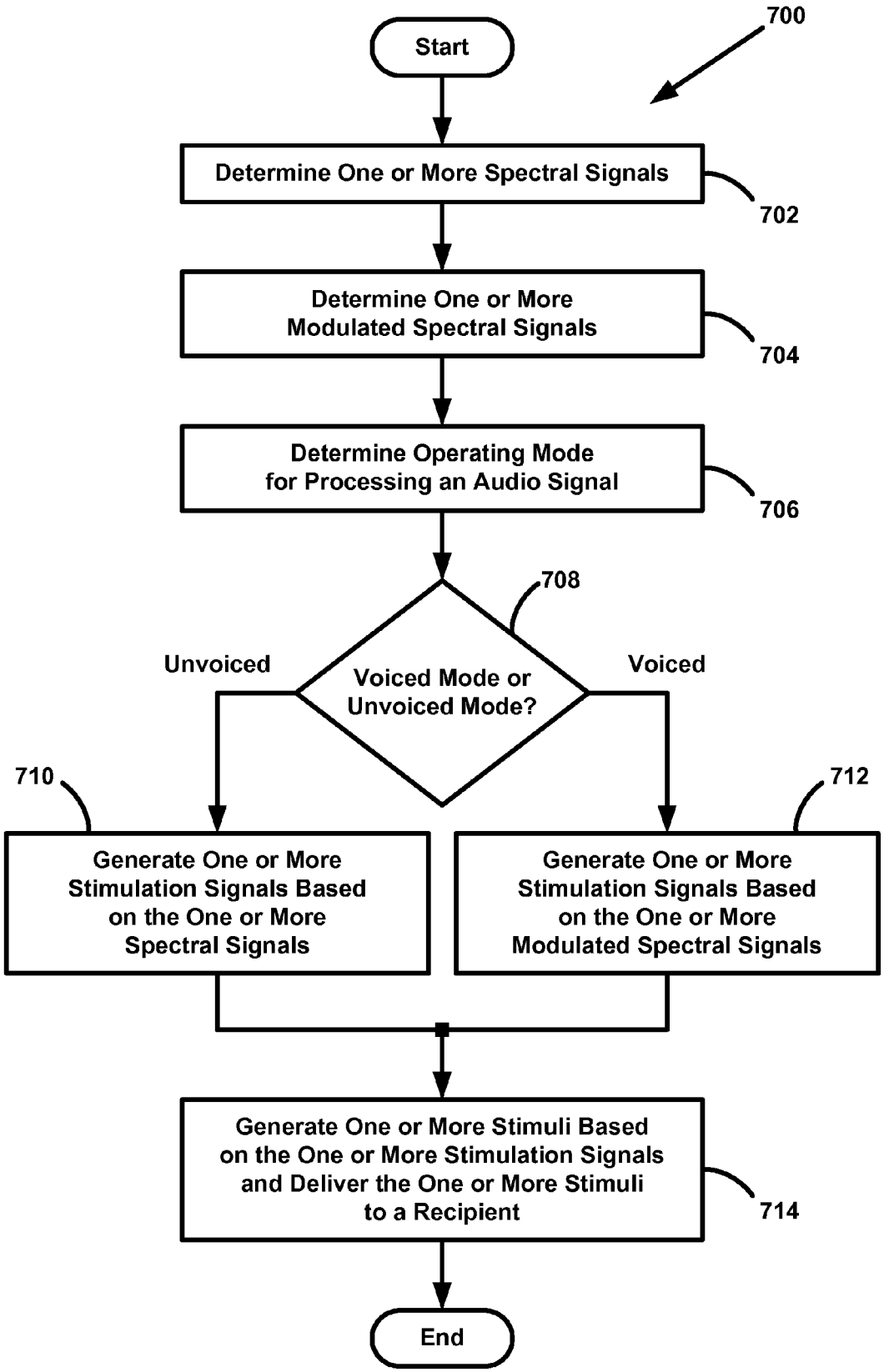
FIG. 7 is a flow diagram of a method for processing a sound, according to an example.
Figure 8:
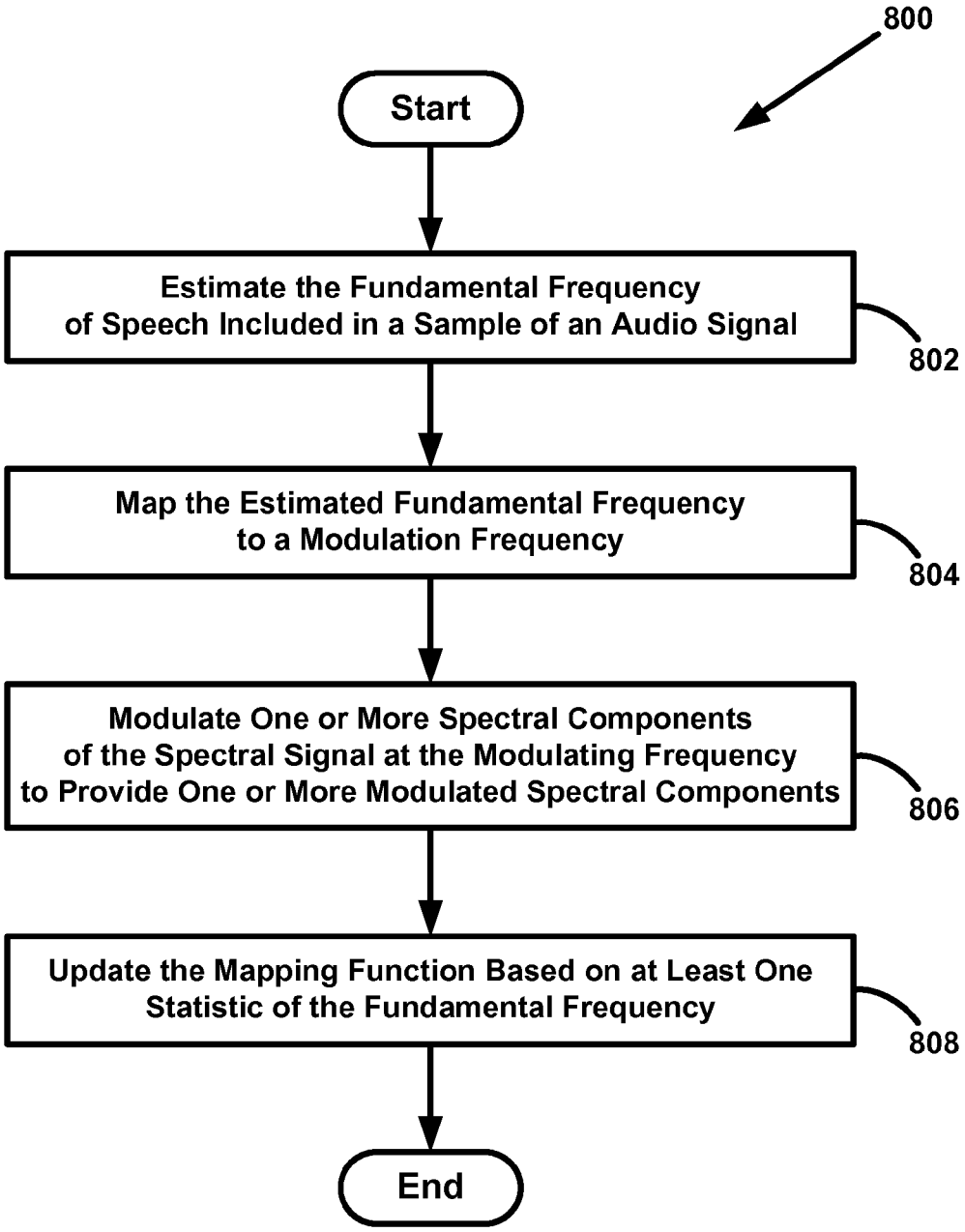
FIG. 8 is a flow diagram of a method for modulating one or more spectral components of a stimulation signal, according to an example.

FIG. 7 is a flow diagram of a method 700 for processing a sound. A sound processor performs the steps of one or more blocks of the method 700 to determine one or more stimuli that allow a recipient to perceive a portion of a sound. While the hearing prosthesis 100, the processing unit 200, the implanted unit 300, and the system 400 are described for purposes of illustrating the method 700 and other methods disclosed herein, it is understood that other devices may be used.

At block 702, the method 700 includes determining one or more spectral signals of an audio signal. In one example, the sound processor 208 determines the one or more spectral signals by performing the functions of the pre-filter module 404 and the filter bank module 406 described with respect to FIG. 4A. At block 704, the method 700 includes determining one or more modulated spectral signals. In one example, the sound processor 208 determines the one or more modulated spectral signals by performing the functions of the modulation module 408 described with respect to FIG. 4A. Example methods for determining the one or more modulated spectral signals are discussed herein with respect to FIGS. 8 and 9.

At block 706, the method 700 includes determining an operating mode of the processing unit 102. In one example, the sound processor 208 includes a voice switch configured to analyze a sample of an audio signal to determine whether the operating mode is a voiced mode or an unvoiced mode. In another example, the sound processor 208 estimates a fundamental frequency of a sample of the audio signal to determine the operating mode. For instance, if the sound processor 208 estimates the fundamental frequency of the sample as being less than the about 500 Hz, the sound processor 208 determines that the operating mode is the voiced operating mode. Otherwise, the sound processor 208 determines that the operating mode is the unvoiced operating mode. In yet another example, the sound processor 208 uses any method, process, and/or algorithm now known or later developed to determine the operating mode of the processing unit 102.

At block 708, the method 700 includes a decision point based on the operating mode. If the operating mode is the unvoiced operating mode, the method 700 continues at block 710, which includes generating one or more stimulation signals based on the one or more spectral signals. If the operating mode is the voiced operating mode, the method 700 continues at block 712, which includes generating one or more stimulation signals based on the one or more modulated spectral signals. In one example, the sound processor 208 performs the steps of blocks 710 and 712 by performing the functions of the channel-selection module 410 and the channel mapping module 412 described with respect to FIG. 4A. In an example in which the sound processor 208 implements the steps of block 704 by performing the functions of the modulation module 440 described with respect to FIG. 4C, the sound processor 208 does not perform the steps of block 708 or 710. Instead, the sound processor 208 performs the steps of block 712 to generate the one or more stimulation signals.

At block 714, the method 700 includes generating one or more stimuli based on the one or more generated stimulation signals and delivering the one or more stimuli to the user. The sound processor 208 sends one or more stimulation signals to the transceiver 210, which includes each stimulation signal in a transmission of the modulated power signal 120. The implanted unit 104 receives the modulated power signal 120 from the processing unit 102, and the one or more stimulation signals are removed from the modulated power signal 120. The stimulation component 308 generates the one or more stimuli based on the one or more received stimulation signals included in the modulated power signal. The stimulation component 308 then delivers the one or more stimuli to the recipient. After completing the steps of block 714, the method 700 may end. The sound processor 208 may perform additional iterations of the method 700 to process subsequent audio signals.

The method 800 is a flow diagram of a method for modulating one or more spectral components of a signal. A sound processor performs the steps of the method 800 when performing the steps of block 704 of the method 700. At block 802, the method 800 includes estimating the fundamental frequency of a sample of an audio signal. In one example, the sound processor 208 performs the steps of block 802 by performing the function of the fundamental frequency estimation module 422 described with respect to FIG. 4B. In another example, the sound processor 208 and/or processing unit 200 includes an additional component configured to estimate the fundamental frequency of voiced speech included in the sample. In yet another example, the sound processor 208 employs any suitable method, algorithm, or process suitable for determining the fundamental frequency of the voiced speech included in the sample.

At block 804, the method 800 includes mapping the estimated fundamental frequency to a modulated fundamental frequency. The sound processor 208 performs the steps of block 804 by performing the functions of the pitch mapping module 424 described with respect to FIG. 4B. In one example, the sound processor 208 uses a mapping function to map the fundamental frequency to the modulation frequency, such as one of the second mapping function or the third mapping function described with respect to FIG. 5. In another example, the sound processor 208 uses any mapping function suitable for mapping the fundamental frequency to the modulation frequency.

At block 806, the method 800 includes modulating the one or more spectral components of the spectral signal at the modulating frequency to provide a modulated spectral signal. The sound processor 208 may also pass the spectral signal through a low-pass filter, such as the low-pass filter 428 described with respect to FIG. 4B. In one example, the sound processor 208 amplitude-modulates the one or more spectral components of the spectral signal. The amplitude-modulation may be based on a raised cosine, a power of sinusoidal function, and/or any other form of amplitude modulation suitable for use in a hearing prosthesis system. Alternatively, the sound processor 208 uses any form of modulation suitable for compressing the fundamental frequency of the voiced speech included in the audio signal to a modulation frequency.

At block 808, the method 800 includes updating the mapping function based on at least one statistic of the estimated fundamental frequency. The sound processor 208 performs the step of block 808 by performing the functions of the map adjustment module 426 described with respect to FIG. 4B. In an alternative arrangement, the sound processor 208 performs the step of block 808 prior to performing the steps 804. After performing the step of block 808, the method 800 ends.

Figure 9:
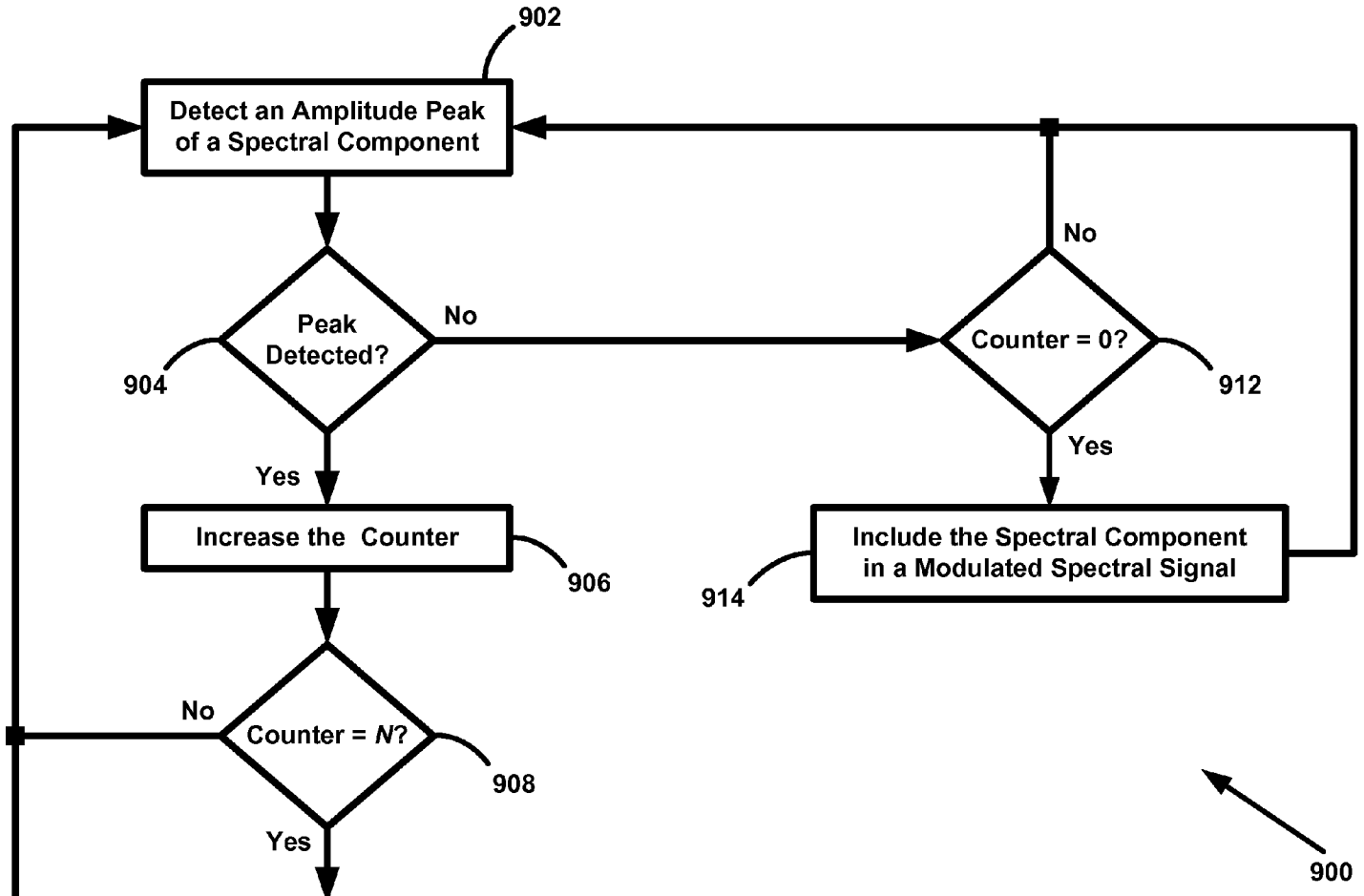
FIG. 9 is a flow diagram of a method for determining when to include a spectral component in a modulated spectral signal, according to an example.

FIG. 9 is a flow diagram of a method 900 for determining when to include a spectral component of a spectral signal in a modulated spectral signal. A sound processor performs the steps of the method 900 for each spectral component of an audio signal when performing the steps of block 704 of the method 700. At block 902, the method 900 includes detecting an amplitude peak of a spectral component of an audio signal. The sound processor 208 performs the steps of block 902 by performing the functions of the peak detection module 442 described with respect to FIG. 4C. At block 904, the method 900 includes determining whether a peak was detected. If a peak was not detected, the method 900 includes increasing the counter at block 906. After increasing the counter, the method 900 includes determining whether the value of the counter equals N, at block 908. If the value of the counter does not equal N, the method 900 includes returning to block 902 to determine if the next sample of the unvoiced spectral signal includes an amplitude peak at the gating spectral frequency. If the counter equals N, the sound processor 208 has detected the $N^{th}$ amplitude peak of the spectral component, and the sound processor 208 zeros the counter to begin a gate-on period, at block 910. After the counter is zeroed, the method 900 includes returning to block 902.

If the sound processor 208 determines that a peak is not detected at block 904, the method 900 includes determining whether the counter equals zero, at block 912. If the counter equals zero, indicating the gate-on period, the method 900 includes including the spectral component in a pulse-modulated spectral signal, at block 914. The sound processor 208 performs the steps of block 914 by performing the function of the gating module 444 described with respect to FIG. 4C. The method 900 includes returning to block 902 after performing the steps of block 914.

In the preceding examples, the sound processor 208 is described as performing one of the methods 800 or 900 when performing the steps of block 704 of the method 700. In one example, the sound processor 208 may switch between performing the steps of the methods 800 and 900 when performing the steps of block 704. As previously described, modulating the one or more spectral components of the spectral signal may improve the recipient's perception of tonality, prosody, and gender identification. One disadvantage of modulating each spectral component is the possibility of errors in the estimated fundamental frequency, especially at higher pitch frequencies. In contrast, modulating a rate at which the voiced spectral signal is generated (or a pulse rate) may provide for more natural sounding speech as perceived by the recipient.

In this example, the sound processor 208 takes advantage of both methods of modulating the spectral signal. The sound processor 208 employs the method 900 when an average estimated fundamental frequency is above a threshold pitch, and employs the method 800 when the average estimated fundamental frequency is below the threshold pitch. An audiologist or other specialist may determine the threshold pitch for the hearing prosthesis 100 during fitting.

With respect to any or all of the block diagrams, examples, and flow diagrams in the figures and as discussed herein, each step, block and/or communication may represent a processing of information and/or a transmission of information in accordance with example embodiments. Alternative embodiments are included within the scope of these example embodiments. In these alternative embodiments, for example, functions described as steps, blocks, transmissions, communications, requests, responses, and/or messages may be executed out of order from that shown or discussed, including in substantially concurrent or in reverse order, depending on the functionality involved. Further, more or fewer steps, blocks and/or functions may be used with any of the message flow diagrams, scenarios, and flow charts discussed herein, and these message flow diagrams, scenarios, and flow charts may be combined with one another, in part or in whole.

A step or block that represents a processing of information may correspond to circuitry that can be configured to perform the specific logical functions of a herein-described method or technique. Alternatively or additionally, a step or block that represents a processing of information may correspond to a module, a segment, or a portion of program code (including related data). The program code may include one or more instructions executable by a processor for implementing specific logical functions or actions in the method or technique. The program code and/or related data may be stored on any type of computer-readable medium, such as a storage device, including a disk drive, a hard drive, or other storage media.

The computer-readable medium may also include non-transitory computer-readable media such as computer-readable media that stores data for short periods of time like register memory, processor cache, and/or random access memory (RAM). The computer-readable media may also include non-transitory computer-readable media that stores program code and/or data for longer periods of time, such as secondary or persistent long term storage, like read only memory (ROM), optical or magnetic disks, and/or compact-disc read only memory (CD-ROM), for example. The computer-readable media may also be any other volatile or non-volatile storage systems. A computer-readable medium may be considered a computer-readable storage medium, for example, or a tangible storage device.

Moreover, a step or block that represents one or more information transmissions may correspond to information transmissions between software and/or hardware modules in the same physical device. However, other information transmissions may be between software modules and/or hardware modules in different physical devices.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A sound processor configured to:

receive an audio signal that includes voiced speech;

based on the audio signal, (i) generate a spectral signal, (ii) determine a modulation frequency such that the modulation frequency is within a range of pitch frequencies a recipient is capable of perceiving, wherein a ratio of the modulation frequency to a fundamental frequency of the voiced speech is less than one over the range of pitch frequencies, and (iii) modulate at the modulation frequency one or more spectral components of the spectral signal to generate a modulated spectral signal; and send the modulated spectral signal to an output device, thereby causing the output device to deliver an output that is configured to allow the recipient to perceive at least a portion of the audio signal.

2. The sound processor of claim 1, wherein, to determine the modulation frequency, the sound processor is configured to:

map the fundamental frequency of a portion of the audio signal to the modulation frequency, wherein the fundamental frequency is greater than an intersection frequency, and wherein the intersection frequency is a frequency at which the output of the mapping is the fundamental frequency.

3. The sound processor of claim 1, wherein the range of pitch frequencies is between about 100 Hz to about 500 Hz.

4. The sound processor of claim 3, wherein the range of pitch frequencies is between about 100 Hz to about 185 Hz.

5. A method of processing an audio signal, the method comprising:

detecting a plurality of amplitude peaks of M spectral components of the audio signal, wherein each of the M spectral components corresponds to one of M frequencies, and wherein M is an integer greater than one; and for each of the M spectral components:

determining whether N amplitude peaks of the spectral component have been detected, wherein N is an integer greater than one;

beginning a period upon determining that N amplitude peaks have been detected; and during the period, (i) including the spectral component in a first spectral signal and including the spectral component in a second spectral signal, wherein the first spectral signal is generated at a first time and the second spectral signal is generated at a second time, wherein the first time occurs before the second time; and (ii) generating and delivering to a recipient a stimulus based on each of the first spectral signal and the second spectral signal.

6. The method of claim 5, wherein a time at which the first spectral signal is generated is approximately synchronized to detecting the $N_{th}$ amplitude peak.

7. The method of claim 5, further comprising ending the period after detecting the $N_{th}+1$ amplitude peak.

8. The method of claim 5, wherein including the spectral component in the first spectral signal occurs after an interval of time of detecting the $N_{th}$ amplitude peak.

9. The method of claim 5, wherein the spectral component included in the second spectral signal is substantially the same as the spectral component included in the first spectral signal.

10. The method of claim 5, wherein a value of N depends on a range of pitch frequencies a recipient can perceive.

11. The method of claim 10, wherein the range of pitch frequencies is between about 100 Hz to about 500 Hz.

12. The method of claim 11, wherein the range of pitch frequencies is between about 100 Hz to about 185 Hz.

13. The method of claim 5, further comprising:

generating at least a first stimulus based on the first spectral signal at a first time and a second stimulus based on the second spectral signal at a second time, wherein the first time precedes the second time.

14. The method of claim 13, wherein a difference between the first time and the second time is approximately constant for two or more periods.

15. The method of claim 13, further comprising:

determining an average of differences in times at which successive amplitude peaks included in the plurality of amplitude peaks are detected, wherein a difference between the first time and the second time depends on the average of differences.

16. The method of claim 5, wherein determining that N amplitude peaks have been detected includes:

determining a difference between two successive amplitude peaks;

determining whether the difference is greater than a threshold difference;

in response to determining that the difference is greater than the threshold difference, zeroing a counter; and in response to determining that the difference is less than or equal to the threshold difference, incrementing the value of the counter by one, wherein N amplitude peaks have been detected when the value of the counter equals N.

17. The method of claim 5, wherein the period is a gate-on period.

18. A non-transitory computer-readable memory having stored therein instructions executable by a computing device to cause the computing device to perform functions for processing an audio signal comprising:

receiving an audio signal that includes voiced speech;

generating one or more spectral signals that include one or more spectral components of the audio signal; and modulating the one or more spectral signals at a modulation rate to provide one or more modulated spectral signals, wherein a ratio of the modulation rate to a fundamental frequency of the voiced speech is less than one over a range of pitch frequencies a recipient can perceive.

19. The non-transitory computer-readable memory of claim 18, wherein the functions further comprise:

generating one or more modulated stimulation signals based on the one or more modulated spectral signals.

20. The non-transitory computer-readable memory of claim 19, wherein modulating the one or more spectral signals includes:

estimating the fundamental frequency of the voiced speech included in the audio signal;

determining an output of a mapping function that represents the modulation rate as a function of the fundamental frequency, wherein the mapping function depends on at least the range of pitch frequencies the recipient can perceive.

21. The non-transitory computer-readable memory of claim 19, wherein modulating the one or more spectral signals includes adjusting a rate at which the one or more modulated stimulation signals are generated by:

detecting a plurality of amplitude peaks of the audio signal at one or more frequencies; and generating at least one stimulation signal during one or more periods, wherein each period begins upon detecting an $N_{th}$ amplitude peak and ends upon detecting an $N+1_{th}$ amplitude peak, and wherein N is an integer greater than one.

22. The non-transitory computer-readable memory of claim 21, wherein a value of N depends on a ratio of fundamental frequencies of speech to pitch frequencies a recipient is capable of perceiving.

23. The non-transitory computer-readable memory of claim 20, wherein the functions further comprise:

determining one or more statistics of the fundamental frequency over a period of time, wherein the one or more statistics include one or more of an average fundamental frequency, a maximum fundamental frequency, a minimum fundamental frequency, or a median fundamental frequency; and modifying the mapping function based on the one or more statistics to increase a likelihood that the fundamental frequency is within an operating range, wherein the operating range depends on the range of frequencies of human speech.

24. The non-transitory computer-readable memory of claim 23, wherein the operating range includes a minimum fundamental frequency and a maximum fundamental frequency, and wherein one of a difference between the maximum fundamental frequency and the minimum fundamental frequency or a ratio of the maximum fundamental frequency to the minimum fundamental frequency is approximately constant.

25. The non-transitory computer-readable memory of claim 18, wherein the range of pitch frequencies is between about 100 Hz to about 500 Hz.

26. The non-transitory computer-readable memory of claim 25, wherein the range of pitch frequencies is between about 100 Hz to about 185 Hz.

27. A hearing device comprising:

a sound processor, the sound processor configured to (i) modulate at least one spectral signal at an effective modulation frequency, wherein a ratio of the effective modulation frequency to a fundamental frequency of voiced speech is less than one over a range of frequencies, and wherein the at least one spectral signal includes information indicative of one or more spectral components of a sample of an audio signal that includes the voiced speech, and (ii) generate a stimulation signal based on the at least one modulated spectral signal; and a stimulation component configured to deliver to a recipient a stimulus, wherein the stimulus is based on the stimulation signal.

28. The hearing device of claim 27, wherein, to modulate the at least one spectral signal, the sound processor is further configured configurable to:

estimate the fundamental frequency of the voiced speech included in the sample of the audio signal; and determine the effective modulation frequency based on a mapping function, wherein the mapping function represents the effective modulation frequency as a function of the fundamental frequency, and wherein the effective modulation frequency is between a minimum pitch and a maximum pitch that a recipient can perceive.

29. The hearing device of claim 28, wherein the sound processor is further configured to modify the mapping function by shifting an operating range included in the mapping function based on one or more statistics of the fundamental frequency, wherein the operating range depends in part on a range of pitch frequencies the recipient is capable of perceiving, and wherein the one or more statistics include one or more of an average fundamental frequency, a median fundamental frequency, a minimum fundamental frequency, or a maximum fundamental frequency.

30. The hearing device of claim 27, wherein, to modulate the at least one spectral signal, the sound processor is further configured to detect a plurality of amplitude peaks of the audio signal at one or more frequencies, and wherein the module is further configured to modulate the at least one spectral signal by:

detecting an $N_{th}$ amplitude peak, wherein N is an integer greater than one, and wherein the ratio of the effective modulation frequency to the fundamental frequency is 1/N;

beginning a period in response to detecting the $N_{th}$ amplitude peak;

determining at least one stimulation signal during the period based on the one or more spectral components; and ending the period upon detecting the $N+1_{th}$ amplitude peak.

31. The hearing device of claim 30, wherein a time at which the at least one stimulation signal is determined is synchronized to detecting the $N_{th}$ amplitude peak.

32. The hearing device of claim 29, wherein the range of pitch frequencies the recipient is capable of perceiving is between about 100 Hz to about 500 Hz.

33. The hearing device of claim 32, wherein the range of pitch frequencies the recipient is capable of perceiving is between about 100 Hz to about 185 Hz.

* * * * *